US009850580B2

(12) United States Patent
Corcoruto et al.

(10) Patent No.: US 9,850,580 B2
(45) Date of Patent: Dec. 26, 2017

(54) ALLOY COMPOSITION FOR THE MANUFACTURE OF PROTECTIVE COATINGS, ITS USE, PROCESS FOR ITS APPLICATION AND SUPER-ALLOY ARTICLES COATED WITH THE SAME COMPOSITION

(71) Applicant: ANSALDO ENERGIA S.p.A, Genoa (IT)

(72) Inventors: Sergio Corcoruto, Turin (IT); Tatiana Falcinelli, Rome (IT); Fabrizio Casadei, Rome (IT)

(73) Assignee: ANSALDO ENERGIA S.P.A., Genoa (IT)

( * ) Notice: Subject to any disclaimer, the term of this patent is extended or adjusted under 35 U.S.C. 154(b) by 0 days.

(21) Appl. No.: 14/548,995

(22) Filed: Nov. 20, 2014

(65) Prior Publication Data

US 2015/0159278 A1 Jun. 11, 2015

Related U.S. Application Data

(62) Division of application No. 12/159,484, filed as application No. PCT/IT2005/000771 on Dec. 28, 2005, now Pat. No. 8,920,883.

(51) Int. Cl.

| | |
|---|---|
| ***C23C 30/00*** | (2006.01) |
| ***C22C 19/05*** | (2006.01) |
| ***B22F 9/08*** | (2006.01) |
| ***C22C 27/06*** | (2006.01) |
| ***C22C 30/00*** | (2006.01) |
| ***C23C 4/073*** | (2016.01) |

(52) U.S. Cl.

CPC ..... *C23C 30/00* (2013.01); *B22F 9/082* (2013.01); *C22C 19/058* (2013.01); *C22C 27/06* (2013.01); *C22C 30/00* (2013.01); *C23C 4/073* (2016.01)

(58) Field of Classification Search

CPC ..... C22F 1/10; C22C 30/00; C22C 19/058; C22C 27/06; C23C 4/073

See application file for complete search history.

(56) References Cited

U.S. PATENT DOCUMENTS

| | | | |
|---|---|---|---|
| 3,918,139 | A | 11/1975 | Felten |
| 3,928,026 | A | 12/1975 | Hecht et al. |
| 4,451,299 | A | 5/1984 | Smeggil et al. |
| 4,683,119 | A | 7/1987 | Selman et al. |
| 5,268,238 | A | 12/1993 | Czech et al. |
| 5,455,119 | A | 10/1995 | Taylor et al. |
| 6,183,888 | B1 | 2/2001 | Alperine et al. |
| 6,221,181 | B1 | 4/2001 | Bossmann et al. |
| 6,756,131 | B2 | 6/2004 | Oguma et al. |
| 8,920,883 | B2 | 12/2014 | Corcoruto et al. |
| 2002/0157738 | A1 | 10/2002 | Burgel et al. |
| 2005/0064229 | A1 | 3/2005 | Stamm |
| 2009/0175755 | A1 | 7/2009 | Corcoruto et al. |

FOREIGN PATENT DOCUMENTS

| | | |
|---|---|---|
| EP | 0 652 299 | 5/1995 |
| EP | 1 319 730 | 6/2003 |
| GB | 2058835 | 4/1981 |
| GB | 2 095 700 | 10/1982 |
| JP | 2003-183754 | 7/2003 |
| WO | 00/75398 | 12/2000 |

OTHER PUBLICATIONS

"Metallography Microstructures, and Phase Diagrams of Nickel and Nickel Alloys", ASM International, Materials Park, Ohio, ASM Specialty Handbook:Nickel, Cobalt, and Their Alloys, Dec. 2000, pp. 302-304.

Suzuki A. et al., "High temperature characteristics of Ir—Ta coated and aluminized Ni-base single crystal superalloys", Science and Technology of Advanced Materials, vol. 5, pp. 555-564 (2004).

Beele W. et al., "Long-term oxidation tests on a Re-containing MCrAlY coating", Surface and Coatings Technology, vol. 94-95, pp. 41-45 (1997).

*Primary Examiner* — Jessee Roe

(74) *Attorney, Agent, or Firm* — Greenblum & Bernstein, P.L.C.

(57) ABSTRACT

Alloy composition for the manufacture of protective coatings, comprising cobalt, nickel, chromium, aluminum, yttrium and iridium in amounts so as to obtain the phases α, β and σ, in particular for coating a super-alloy article. Preferably, such super-alloy article is a turbine component.

13 Claims, 3 Drawing Sheets a) b)

a) b)

a) b)

a) b)

a) b)

a) b)

ALLOY COMPOSITION FOR THE MANUFACTURE OF PROTECTIVE COATINGS, ITS USE, PROCESS FOR ITS APPLICATION AND SUPER-ALLOY ARTICLES COATED WITH THE SAME COMPOSITION

This application is a Divisional of U.S. patent application Ser. No. 12/159,484, now U.S. Pat. No. 8,920,883, which is a National Stage of International Application No. PCT/IT2005/000771 filed Dec. 28, 2005. The disclosure of U.S. patent application Ser. No. 12/159,484 and International Application No. PCT/IT2005/000771 are expressly incorporated by reference herein in their entireties.

TECHNICAL FIELD

The present invention relates to an alloy composition for the manufacture of protective coatings, its use, process for application and super-alloy articles coated with the same composition.

BACKGROUND ART

It is known that the performance of gas turbines, in terms of efficiency and obtainable power, are intrinsically bound to the maximum temperature of the thermodynamic cycle, that is to the temperature of the hot gases in contact with the metallic walls of its elements, in particular turbine vanes of the first rotor and stator stage.

The super-alloys used in the construction of elements exposed to high temperature are therefore stressed to their technological limits and are consequently subject to processes of oxidation, corrosion and erosion made continuously more taxing by the increasingly high running temperature and use of lower quality fuels.

The need to coat the surface of such elements with elements capable of preserving their structure and prolonging their reliability has therefore arisen.

It is known the coating of super-alloy elements with metallic compositions, for example of the McrAlY type, where M may be Nickel, Cobalt or Iron.

These latter are generally applied by plasma spraying both in air (APS) and in vacuum or at low pressure (VPS or LPPS) or thermal sprayed by oxygen-fuel system (HVOF).

The MCrAlY type compositions are normally used to protect the substrate from oxidation and corrosion.

In particularly taxing environments, such as for example in the case of first stage turbine vanes, the McrAlY composition is generally associated to a overlaid ceramic thermal barrier.

The MCrAlY compositions have the task of protecting the super-alloy substrate from oxidation, but also of anchoring the thermal barrier to it.

Indeed, the aluminium present in the McrAlY composition, coming into contact with the oxygen, oxidises selectively forming a layer of $\alpha$-$Al_2O_3$.

Such oxide, being very compact and chemically stable at the running temperatures of the turbines, between 900° C. and 1100° C., prevents the further diffusion of oxygen towards the underlying metallic substrate protecting the super-alloy element from oxidation.

Furthermore, the anchoring function between substrate and thermal barrier is performed both mechanically, by protrusions, commonly called pegs, generated by the oxidation of Y, Re and Hf, if present, and by diffusion of $Al^{3+}$ ions in the thermal barrier itself.

The MCrAlY type composition can be assimilated macroscopically to a metallic alloy constituted mainly by a lattice $\gamma$, comprising prevalently Ni, Co and Cr, in which are dispersed particles of a second Aluminium rich phase $\beta$, in particular in the form Ni—Al and/or Co—Al.

In oxidising environment, the aluminium of phase $\beta$ reacts with the oxygen originating the protective flake of $\alpha$-$Al_2O_3$.

Generally a NiCoCrAlY composition presents better features with respect to a NiCrAlY in terms of coating stability, ductility and resistance to corrosion.

The microstructural features of a coating composition and therefore its performance above all in terms of durability are strongly influenced by the elements which constitute it and by their content by weight.

The constituting elements can be classified in two main categories: reactive elements and noble elements.

The first, mainly Y, Si and Hf, form oxides in the boundary zone with alumina, by reaction with oxygen in the environment. Such oxides are responsible for the formation of preferential routes for oxygen which reacts in turn with the Al of the coating to form an alumina flake capable of incorporating the previously formed oxides stabilising the protective flake. In the presence of overlaying thermal barrier, these act mechanically as anchoring between the alumina and the thermal barrier itself.

Another main function of the reactive elements is to slow down the diffusion of the aluminium and of the chromium of the coating outwards preventing depletion and therefore prolonging life.

The presence of reactive elements also helps to prevent the segregation of sulphur at the interface between the alumina flake and the coating. The presence of chromium is effective against the hot corrosion which, with the formation of embrittling sulphides raises the ductile-brittle transition temperature (DBTT).

The noble elements, such as Re and Pt, in virtue of their large dimensions and higher density can interact as diffusive barriers for carrying aluminium and chromium outwards but also oxygen inwards. In that way, the growth of the alumina flake is thus slowed down as the depletion of the phase $\beta$, which otherwise would cause exhaustion of the aluminium reserve and loss of protective efficiency of the coating with consequent formation of microcavities and therefore thermo-mechanical fatigue phenomena in the super-alloy element.

Currently there are known different types of MCrAlY type compositions for coating super-alloy articles.

From U.S. Pat. No. 5,268,238 it is known, for example, a composition of the MCrAlY type with possible additions of Re, Si and elements such as Hf, W, Ta, Ti, Nb, Mn and Zr.

Furthermore, from U.S. Pat. No. 6,756,131, it is known the use of a composition of the MCrAlY type resistant to high temperatures comprising nickel, cobalt, chromium, aluminium, yttrium, and rhenium.

In particular, as shown in W. Beele et al. (Surface and coating Technology, 1997, 94-95), Rhenium is capable of slowing down the depletion of the phase $\beta$, by forming a chromium rich phase $\sigma$ immediately under the $Al_2O_3$ flake, and a phase $\alpha$, even richer in chromium than phase $\sigma$. Such phases compensate the depleted zones and thus prevent the embrittlement of the coating, hindering the formation of voids. Table 1 shows the chemical composition of the phases present in a generic NiCoCrAlYRe composition.

TABLE 1

| Phase | Ni | Co | Cr | Al | Y | Re |
|---|---|---|---|---|---|---|
| γ | 39 | 24 | 28 | 8 | — | 1 |
| β | 50 | 11 | 7 | 32 | — | — |
| α | 5 | 4 | 81 | — | — | 9 |
| σ | 11 | 19 | 50 | 2 | 9 | 8 |

The metallic rhenium being a large and heavy atom (atomic weight=186.2) behaves as a noble element interfering on diffusivity, inhibiting the growth of the flake and therefore delaying the depletion of the phase β.

Disadvantageously, the rhenium, when present in contents higher than 3%, however manifests an embrittling effect of the coating; such embrittling effect of Rhenium therefore reduces, in practice, applicability.

Furthermore, the compositions of the MCrAlY type comprising rhenium, when applied onto cobalt based substrates, show an even more marked embrittlement also with minimum contents of rhenium, and therefore cannot be successfully used on all cobalt based super-alloy components.

The development of new coating compositions free from the drawbacks of the prior art is therefore a fundamental need in the super-alloy element protective coating technology sector.

U.S. Pat. No. 6,183,888 describes a process for the manufacture of a protective coating of super-alloy articles which envisages the deposit of an alloy powder comprising at least Cr, Al and an active element with a residual open porosity followed by the deposit of a further layer comprising at least one metal of the platinum group, such as for example ruthenium, rhodium or iridium, so as to fill the residual open porosity. The process described in U.S. Pat. No. 6,183,888 shows a deposition phase of a layer of iridium on a layer of MCrAlY alloy then followed by a diffusion phase by means of thermal treatment. Such process is however complex, long and costly.

DISCLOSURE OF INVENTION

It is the object of the present invention to provide an alloy composition for the protective coating of super-alloy articles, particularly (but not only) gas turbine components, for example first stage vanes, which allows to obtain improved performance or however comparable to that ensured by known coating alloy compositions, combined with the prolongation of the life of the coatings, and, consequently, of the life of the coated articles as a whole, this all ensuring a possibility of application on the substrate with a simple and relatively low-cost process.

According to the present invention, such object is reached by means of an alloy composition for making protective coatings according to claim 1.

The composition may comprise rhenium, preferably present in an amount lower than 2%, more preferably in an amount from 0.5% to 1.5%.

In a preferred embodiment, the composition comprises 24.1% of cobalt, 47.59% of nickel, 16.8% of chromium, 9.7% of aluminium, 0.41% of yttrium and 1.40% of iridium.

Such alloy composition differs from all the others currently used for the presence of iridium and is aimed at improving the effect in part performed by the rhenium and at overcoming the limits due to embrittlement.

The effect of the iridium on the coating is comparable to that of the noble elements given its large atomic size and its density.

Furthermore, the iridium has a higher atomic weight (atomic weight=192.2) with respect to rhenium and is therefore more prone to hindering the diffusion of aluminium and chromium, and of oxygen, thus preventing a rapid and uneven growth of the alumina flake.

Unlike rhenium, whose lattice is close compact hexagonal, iridium has face-centred cubic (fcc) crystalline structure as the metallic alloys forming the substrate: this provides a higher compatibility with the basic alloy, important aspect for the purpose of coating durability.

Iridium, in oxidising environment, is capable of forming stabile oxides of the $Ir_2O_3$ and $IrO_2$ type and has a distinct action capacity as diffusive barrier because its diffusivity for oxygen is extremely low.

Furthermore, it has been observed that the alloys containing both iridium and aluminium are also of forming, in oxidising environment, a compact flake of alumina anchored onto a layer of iridium; therefore, the alloys according to the invention are capable of providing the same advantages of known Re based alloys, but without the disadvantage of embrittlement and, equally, without the need to preventively deposit the layer of Ir, as conversely known from U.S. Pat. No. 6,183,888, because the layer of Ir is formed alone, during the use of the alloy. Additionally, iridium has a high resistance to corrosion, improved indeed by the combined action with Ni, Co and Al.

Intermetallic compounds with chromium and cobalt, for example $Co_3Ir$ and $CoIr_3$ type have also been identified for iridium.

The amounts of cobalt, nickel, chromium, yttrium, aluminium, iridium, and rhenium present in the coating composition of the invention are such to obtain the formation of chromium rich phases α and σ.

Furthermore, such quantities allow the formation of a phase β and the formation of a phase γ, both in the presence and in the absence of Re.

The composition of the invention may be presented in different forms but preferably it is in powder form.

The present invention also relates to the use of the composition defined above for coating a super-alloy article. Preferably, such article is a turbine component.

According to a further aspect of the invention, it is provided a process for applying the coating composition comprising a step of thermal spraying of the composition in powder form.

Such process may also comprises a pulverisation step of the composition previously formed by casting in master alloy ingots.

The pulverisation step comprises, after a first manufacturing step of the master alloy ingots, the subsequent steps of re-melting and atomising the master alloy in an atomisation gas system.

Finally, it is provided a coated super-alloy article with the composition according to the present invention, preferably a turbine component.

Additional features of the present invention will be apparent in the description that follows only by way of non-limitative example.

EXAMPLE

Figure 1:
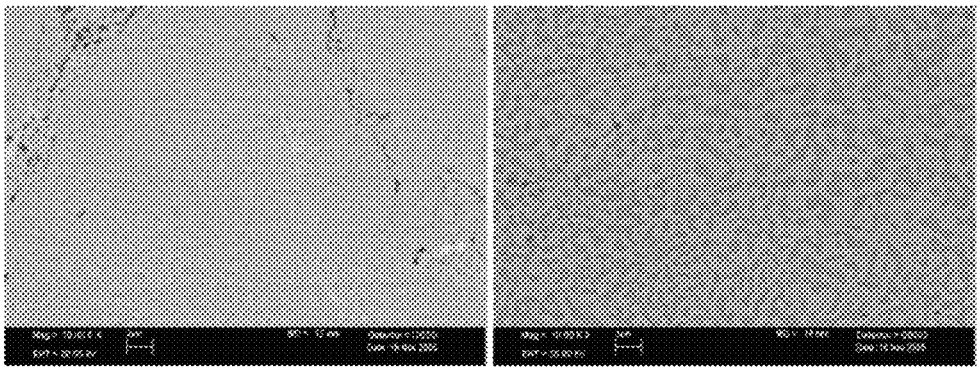
FIGS. 1 and 2 show the SEM micrographs of the four coatings made in the Examples.

Preparation of the coating composition in powder form.

The pulverisation step comprises a first manufacturing step of the master alloy ingots and the subsequent steps of re-melting and atomising the master alloy in an atomisation gas system.

The master alloy ingots are made using a vacuum induction oven. The VIM (Vacuum Induction Melting) technology is the most versatile melting process for the production of nearly all Fe, Ni and Co based special alloys, and is also the only allowed for some aeronautic applications, not only for the production of ingots but also of castings.

There were thus melted Ni, Co, Cr and Ir filling elements with purity no lower than 99.9%, by means of a water cooled copper coil through which passes an alternating current that is wound about the refractory crucible thus generating eddy currents in the filling material which is heated by joule effect.

The magnetic agitation, which the process generates in the bath, ensures the homogenisation and the more accurate control of molten chemistry and temperature, and the transport of material needed to perform the chemical-physical reaction needed, for example, for degassing by means of rotary vacuum pumps.

It also allows an exact composition and product reproducibility.

Later, Al is added, a further degassing is performed and it is added, by means of a loading system placed on the top of the oven, the yttrium, reactive component of the composition.

After mixing of the bath, it is performed the chemical analysis and possible additions of principle elements in the case of lacking in the composition. Finally, the molten metal is cast into ingots.

With the aforesaid process, it was obtained the master alloy for the protective coatings, whose chemical composition is shown in Table 2.

TABLE 2

| Powder Id | Ni | Co | Cr | Al | Ir | Y |
|---|---|---|---|---|---|---|
| A 86 | Bal | 24.1 | 16.8 | 9.7 | 1.4 | 0.41 |

The resulting ingots were later subjected to an atomising gas step, the most common method for producing spherical metallic powders adapted for spraying systems.

Such step consists in the re-melting of the ingots in a ceramic crucible by magnetic induction. After melting and after having reached the correct superheating temperature, the liquid metal is passed from the crucible, through a nozzle, to inside the atomisation chamber where is it struck by a jet of inert pressurised gas, generally nitrogen, helium or argon, which disintegrates the molten metal into small particles.

When the liquid metal encounters the high speed gas, indeed, it is separated into droplets, therefore rapidly cooled by the gassy atmosphere present in the chamber with the subsequent formation of powder.

The ratio between quantity of gas which strikes the molten metal and the molten metal itself determines the particle size of the manufactured powder. The following process parameters allow to vary this gas/metal ratio, such as:

gas pressure
metallostatic pressure
fluid flow rate
material viscosity
gas temperature Higher is the ratio, finer is the size of the obtained powder, and vice versa. The dependence of the gas/metal ratio on the material properties imposes that for each new alloy there are conducted preliminary tests for searching the optimal process parameters.

The powder formed by the master alloy A86 was deposited by VPS on a monocrystal solidified nickel based superalloy substrate. Four different thermal spraying methods varying the process parameters which allowed to obtained 4 different coatings (id. 228-05_1, 228-05_2, 228-05_3, 229-05_1) were used.

Figure 2:
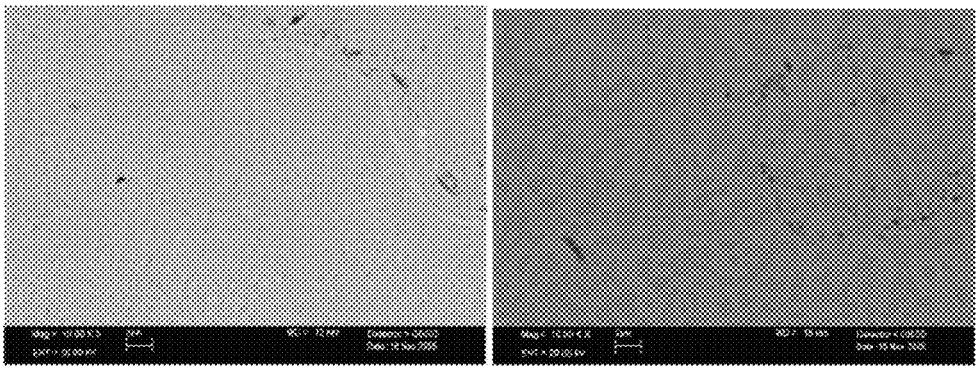

FIGS. 1 and 2 show the SEM micrographs (10000×) of the 4 coatings made. In particular, FIG. 1*a*) shows a SEM 10000× micrograph for sample 228-05_1 and FIG. 1*b*) shows a SEM 10000× micrograph for sample 228-05_2; FIG. 2*a*) shows a SEM 10000× micrograph for sample 228-05_3 and FIG. 2*b*) shows a SEM 10000× micrograph for sample 229-05_1.

Figure 3:
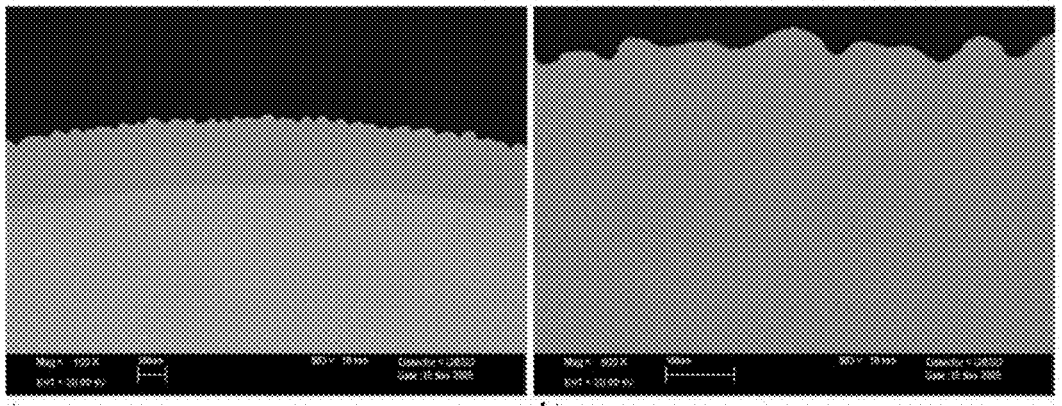
FIGS. 3 and 4 show microstructural details of one of the four coatings made in the Examples.
Figure 4:
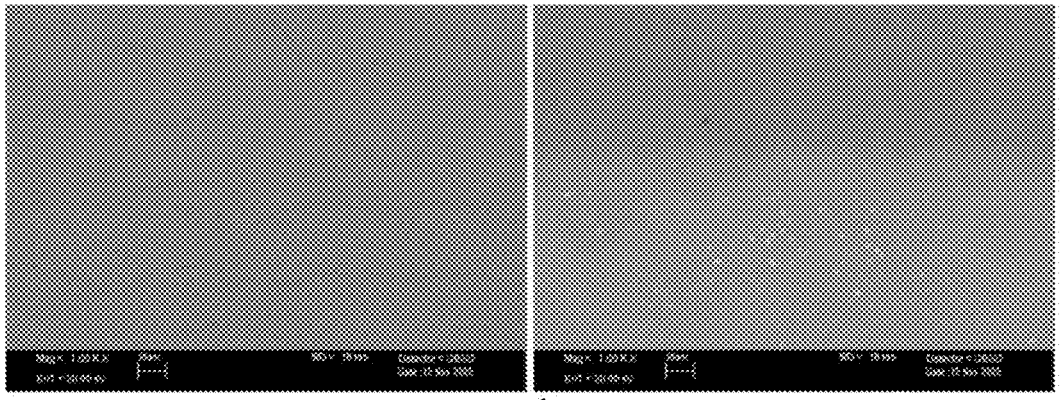

Furthermore, FIGS. 3 and 4 show microstructural details for coating 229-05_1 at lower magnification (100× and 1000×). In particular, FIG. 3*a*) shows a SEM 100× micrograph for sample 229-05_1, while FIG. 3*b*) shows a SEM 1000× micrograph for sample 229-05_1; FIG. 4 shows SEM 1000× micrographs for sample 229-05_1, which shows microstructural details: a) inside the coating; b) coating-substrate interface.

In particular, two distinct phases can be observed in FIGS. 1-4: the lattice γ and the phase β dispersed in it; in particular, in coatings 228-05_2 and 229-05_3 such phases appear to be form macroaggregates indicating a coarser structure.

Figure 5:
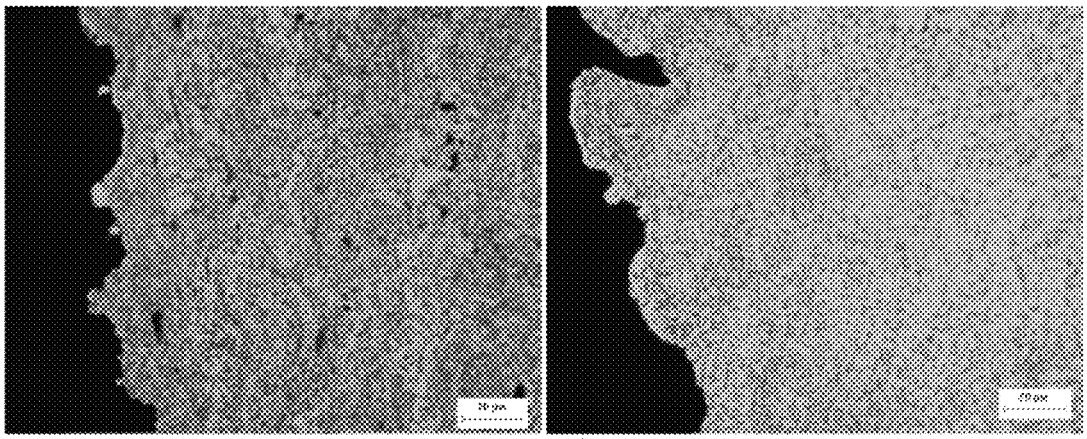
FIGS. 5 and 6 show the microstructures of the four coatings made in the Examples observed under an optical microscope following etching.
Figure 6:
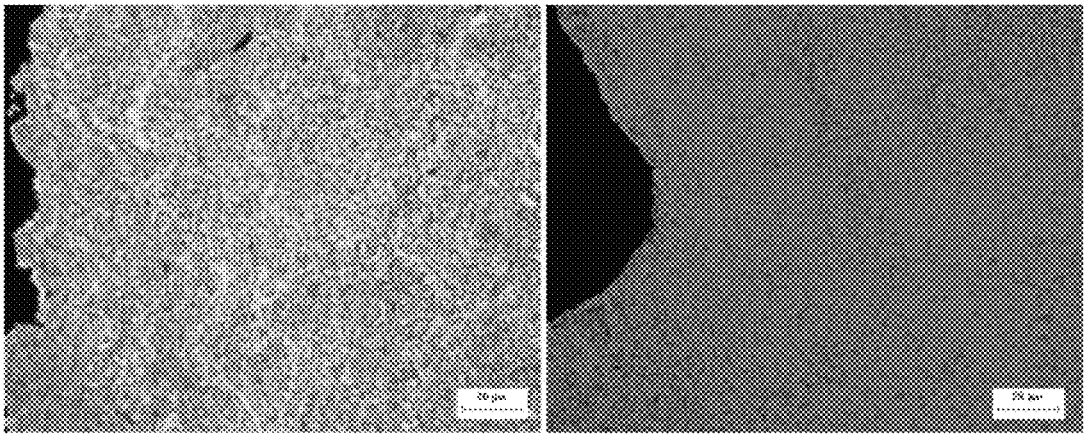

FIGS. 5 and 6 show instead the microstructures of the four samples observed under an optical microscope following etching with nitric acid, acetic acid and hydrofluoric acid which confirm the previous observations. In particular, FIG. 5*a*) shows an optical micrograph after etching with nitric, acetic and hydrofluoric acid for sample 228-05_1, while FIG. 5*b*) shows an optical micrograph after etching with nitric, acetic and hydrofluoric acid for sample 228-05_2; FIG. 6*a*) shows an optical micrograph after etching with nitric, acetic and hydrofluoric acid for sample 228-05_3; and finally, FIG. 6*b*) shows an optical micrograph after etching with nitric, acetic and hydrofluoric acid for the sample 229-05_1.

The invention claimed is:

1. An alloy composition for the manufacture of protective coatings, the alloy composition comprising, by weight, cobalt in amounts from 10 to 30%, nickel in amounts from 30 to 70%, chromium in amounts from 15 to 20%, aluminum in amounts from 8 to 12%, yttrium in amounts from 0.1% and 2%, and iridium in amounts from 0.5 to 3.5%.

2. The composition according to claim 1, further comprising rhenium.

3. The composition according to claim 2, wherein the composition comprises less than 2% by weight of rhenium.

4. The composition according to claim 2, wherein the rhenium is present in an amount of from 0.5% to 1.5% by weight.

5. The composition according to claim 2, wherein the amounts of cobalt, nickel, chromium, aluminum, yttrium, rhenium and iridium are such to obtain the formation of phases α and σ.

6. The composition according to claim 5, wherein the amounts of cobalt, nickel, chromium, aluminum, yttrium, and iridium are such to obtain the formation of a phase β.

7. The composition according to claim 5 wherein the amounts of cobalt, nickel, chromium, aluminum, and iridium are such to obtain the formation of a phase γ.

8. The composition according to claim 1, comprising, by weight, 24.1% of cobalt, 47.59% of nickel, 16.8% of chromium, 9.7% of aluminum, 0.41% of yttrium, and 1.40% of iridium.

9. The composition according to claim 1 wherein the composition is present in powder form.

10. The composition according to claim 1, wherein the composition consists of, by weight, from 10% to 30% of cobalt, from 30% to 70% of nickel, from 15% to 20% of chromium, from 8% to 12% of aluminum, from 0.1% to 2% of yttrium, from 0.5% to 3.5% of iridium.

11. The composition according to claim 1, wherein the composition consists of, by weight, from 10% to 30% of cobalt, from 30% to 70% of nickel, from 15% to 20% of chromium, from 8% to 12% of aluminum, from 0.1% to 2% of yttrium, from 0.5% to 3.5% of iridium, and less than 2% of rhenium.

12. The composition according to claim 11, wherein the amount of rhenium is from 0.5% to 1.5% by weight.

13. A method of making an alloy composition for the manufacture of protective coatings in powder form wherein the composition comprises by weight from 10% to 30% of cobalt, from 30% to 70% of nickel, from 15% to 20% of chromium, from 8% to 12% of aluminum, from 0.1% to 2% of yttrium and from 0.5% to 3.5% of iridium wherein the method comprises an atomization process carried out directly on the alloy in molten state.

* * * * *